United States Patent [19]

Kuban

[11] 4,057,250

[45] Nov. 8, 1977

[54] TENNIS RACKET CONSTRUCTION

[76] Inventor: William G. Kuban, 5125 Ranier Pass, Columbia Heights, Minn. 55421

[21] Appl. No.: 610,534

[22] Filed: Sept. 5, 1975

[51] Int. Cl.[2] ..... A63B 49/02

[52] U.S. Cl. ..... 273/73 G; 273/73 R

[58] Field of Search ..... 273/26 B, 29 A, 67 D, 273/67 DA, 67 DB, 72 R, 72 A, 73 R, 73 C, 73 G, 73 H, 73 J, 162 R, 170; 145/29 B

[56] References Cited

U.S. PATENT DOCUMENTS

| | | | |
|---|---|---|---|
| 1,186,283 | 6/1916 | Coddington | 273/73 G X |
| 1,526,734 | 2/1925 | Andrews et al. | 273/73 J X |
| 3,130,762 | 4/1964 | Kerr | 273/170 X |
| 3,582,072 | 6/1971 | Stueck | 273/73 C X |
| 3,605,832 | 9/1971 | Stephens | 145/29 B X |
| 3,941,380 | 3/1976 | Lacoste | 273/73 G X |

FOREIGN PATENT DOCUMENTS

| | | | |
|---|---|---|---|
| 225,938 | 12/1959 | Australia | 273/170 |
| 974,039 | 9/1950 | France | 273/73 J |
| 942,909 | 11/1963 | United Kingdom | 145/29 B |

*Primary Examiner*—Richard J. Apley
*Attorney, Agent, or Firm*—Dugger, Johnson & Westman

[57] ABSTRACT

The present invention relates to the construction of sports rackets, such as those used for tennis and similar games. The racket has weight means which moves transverse to the plane of the racket stringing, mounted adjacent to the bow or head of the racket to provide inertial rebound deadening when the racket strikes a ball.

7 Claims, 4 Drawing Figures

FIG. 1
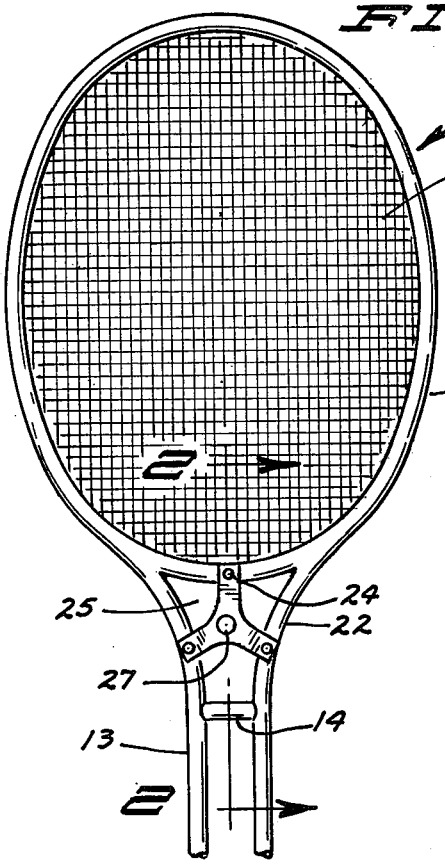
FIG. 2
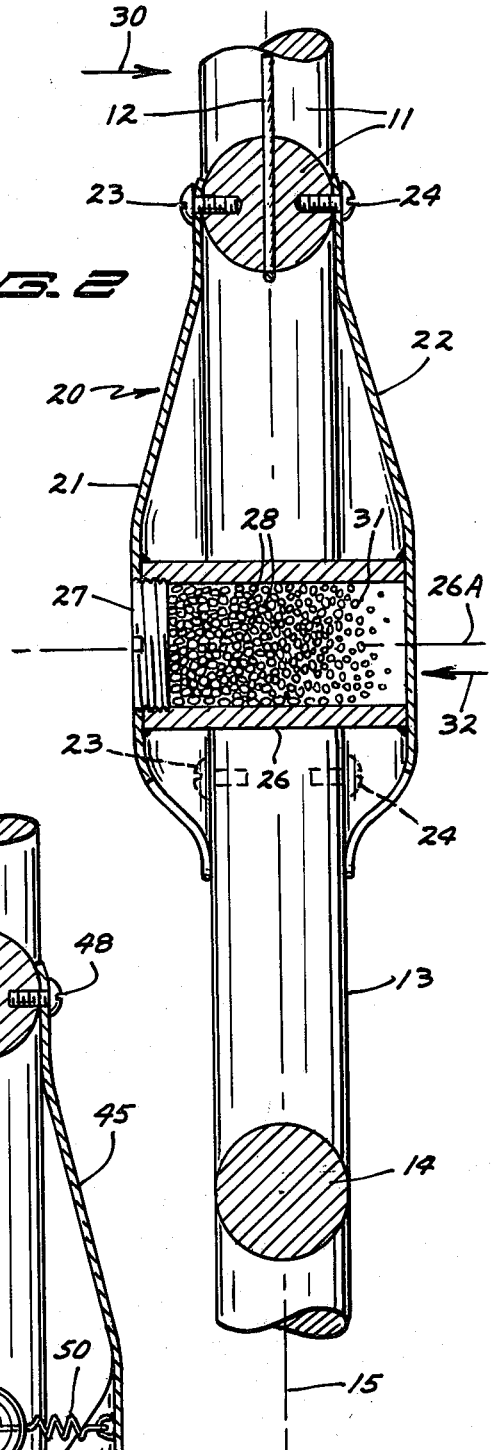
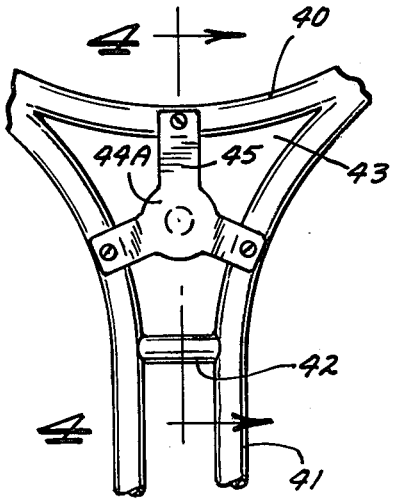
FIG. 3
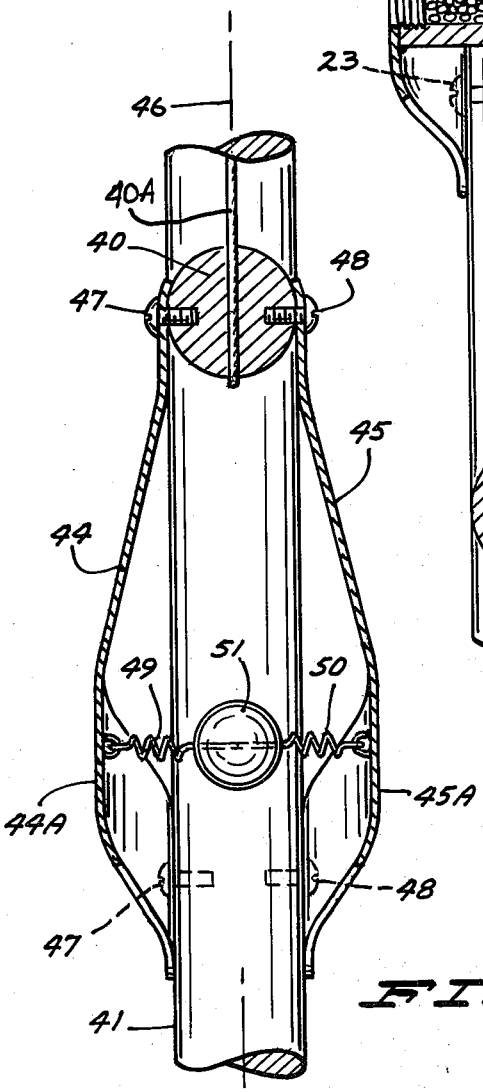
FIG. 4

TENNIS RACKET CONSTRUCTION

BACKGROUND OF THE INVENTION

1. Field of the Invention

The present invention relates to sports rackets, clubs or bats, and in particular sports rackets which include weight attachments that provide for a "dead blow" or inertial reaction against rebound loads when the racket is used.

2. Prior Art

In the prior art, various rackets, including tennis rackets, have used weights which shift axially along the handle to change the balance of the racket during use. The shifting weight is used to attempt to change the center of mass of the racket to coincide more nearly with the point of impact with the ball, to obtain better results in operation. An axially shifting weight sliding along the handle would seem to change the balance and feel of the racket as it is swung, particularly with the extremely light rackets now in use. Examples of this type of construction are shown in U.S. Pat. No. 879,477, issued Feb. 18, 1908, British patent Specification No. 407,983, issued in March of 1934 and Australian Pat. No. 15,733/33 which issued on Dec. 29, 1933. However, the movable weights shown in these patents are capable only of axial movement and will shift relatively large distances during use.

U.S. Pat. No. 2,546,140 shows a tennis racket which has a movable weight in the handle. The weight is not freely movable, however, and is used for balancing the racket.

SUMMARY OF THE INVENTION

The present invention relates to a sports racket, club or bat which includes a weight that may shift a distance in directions generally parallel to the direction of swing or as shown perpendicular to the plane of the stringing of the racket to provide a force which tends to counteract rebound of the racket from impact with the ball. The weight can take any desired form, and will be relatively light so as to not adversely affect the racket weight. The weight will shift transverse to the plane of the racket under acceleration of the racket during a swing. As the racket strikes a ball during play, the weight will then shift or move transverse to the plane of the stringing of the racket (or in direction generally parallel to the direction of swing) and provide an inertial force in direction counteracting the tendency of the racket to rebound.

This will provide a "dead blow" action that is similar to the action obtainable with well known "dead blow" hammers. In the hammers quantities of lead shot are mounted in a container or chamber in the hammer head so that the shot can shift. The lead shot in the hammer will then act as the weight just described to provide a force counteracting the rebounding of a hammer when it strikes a surface. The same force can be provided by a small amount of shifting weight in a sports racket, such as a tennis racket.

In an alternate construction, a small weight is resiliently supported for movement in direction transverse to the plane of the racket, and will, when the racket is swung, shift during the swing of the racket in a direction relative to the plane of the racket opposite from the direction of movement of the racket, and when the racket strikes the ball or object the weight will continue to move in the direction of swing a small distance transverse to the plane of the racket and provide an inertial force tending to prevent the racket from rebounding. This will increase the force that is exerted on the ball by the racket, club or bat and in this way will apply more of the energy of the moving racket to the ball than previously done.

BRIEF DESCRIPTION OF THE DRAWINGS

FIG. 1 is a fragmentary plan view of a typical racket bow showing the stringing in place, and a fragmentary showing of the racket handle with a device made according to one form of the invention installed thereon;

FIG. 2 is a sectional view taken as on line 2—2 in FIG. 1;

FIG. 3 is a fragmentary enlarged plan view of a throat portion of a racket mounting a device made according to a modified form of the present invention; and FIG. 4 is a sectional view taken as on line 4—4 in FIG. 3.

DESCRIPTION OF THE PREFERRED EMBODIMENT

Referring to FIG. 1 in particular, a racket indicated generally at 10, for example a tennis racket, has a bow or frame 11, that is used for attaching suitable racket stringing indicated at 12. The racket may be considered a sports missile striking device, with the stringing 12 providing the missile striking portion. At the present time, many rackets, particularly tennis rackets, are made of metal, are very lightweight, and open to cut down wind resistance. The handle indicated generally at 13 may comprise two members that join the bow 11 and are spaced apart as shown. The handle members are held together with suitable cross members 14 to form a handle that will have a grip at its end. The grip details are not shown because they are well known. The stringing indicated at 12 forms a plane that bisects the bow and handle, and this will be referred to as the "plane of the racket" and is represented on its edge by a line indicated generally at 15 in FIG. 2.

In the first form of the present invention, a rebound absorbing device indicated generally at 20 as shown has a first frame member 21 and a second frame member 22 on opposite sides of the handle 13 and the bow 11. The frame members 21 and 22 form spiders that have three legs, and each of the legs of the frame 21 is attached with a suitable fastening member such as a small screw 23 to a first side of the bow, and to the members forming the handle 13. The legs forming part of the frame member 22 are attached on the opposite side of the frame with suitable screws 24 to the handle and also to the base of the bow of the racket.

As shown, the members forming the handle and the base of the bow form an opan throat portion 25 in which the center portions of the frame members 21 and 22 are positioned. Frame members 21 and 22 are used for holding a small tubular container 26 that is positioned in the open throat 25, and which has a longitudinal axis indicated at 26A that is perpendicular to the plane 15 of the racket stringing. The tubular member 26 has a small filler plug 27 threadably mounted in one end thereof and the plug may be removed for partially filling the tube with small lead shot (small pellets), which are indicated generally at 28. The tube 26 is not completely filled with the pellets, and a void space is provided so that the pellets or shot 28 can shift in the tube 26 when the racket is swung. The total weight of the pellets will not be very high, in the range of a few ounces. The pellets may be selected small shot size, such as number 8 shot or bird shot.

The amount of weight in the tube, and the weight of the tube itself of course is kept to a minimum, consistent with the requirements of the user of the racket. The tube thus is made of a lightweight material. The frames 21 and 22 also can be made of lightweight material such as aluminum or magnesium alloy to minimize the weight but yet to give sufficient rigidity for the desired action. Some resiliency of the frames 21 and 22 may not be objectionable in that it will also add to the "dead blow" producing effect if it shifts slightly in a direction transverse to the plane 15 of the racket.

It should be noted that the frame 22 closes one end of the tube 26, and provides a rebound surface for the shot in the tube.

When the racket is swung for example a direction indicated by the arrow 30, the shot will tend to move in the tube 26 back against the cap 27 during acceleration of the racket, and will remain there during movement of the racket throughout a swing. This will leave a void space indicated at 31 on the end of the tube 26 that is toward the leading side of the racket during the swing. Then, when the ball is struck by the racket, the strings will rebound the ball. The reaction to the force on the ball will tend to rebound the racket in opposite direction as indicated by the arrow 32. The acceleration forces on the racket will change briefly, even with a good follow through of the swing. The shot, having stored energy that has not been expended, will combine to move in the direction of swing and will impinge against the bottom of the opening in the tube 27, and thus against the frame 22 to provide stored energy tending to reduce any rebound of the racket. The energy in the moving shot provides additional impetus to the ball at a slightly delayed time from the original contact of the ball and racket.

While the rebound forces on the racket can become quite complex, depending on many factors, such as the velocity and acceleration of the racket, the weight of the racket, and the weight and velocity of the ball being struck, as a general rule the action of reducing or eliminating rebounding of the racket will tend to increase the velocity of the ball as it is rebounded from the racket.

Some of the energy in the shot will be dissipated in heat by the collision and rubbing together of the individual pellets of lead shot, but most of the energy that is stored in the lead shot will be expended to overcome any tendency of the racket to rebound, and will be useful in propelling the ball being struck.

Stated another way, the shot is mounted so that it may move generally back and forth in a direction parallel to the direction of swing of the racket.

Referring now to FIGS. 3 and 4, in a modified form of the invention a racket frame has a bow base portion 40 and a handle 41 attached to the bow base portion which is made of two members spaced apart and supported by a cross piece 42. The handle members define an open throat 43 similar to the open throat 25 of the first form of the invention.

In the second form of the invention, a pair of support frames 44 and 45 are positioned on opposite sides of the plane of the racket stringing 40A, which plane is indicated at 46. The frames 44 and 45 are fastened to the bow 40 and handle 41 with suitable fasteners 47 and 48, respectively. The opposite ends of the strings 49 and 50 are attached to a suspended weight 51 that is held substantially midway between the frames 44 and 45, and that is spring mounted with a light resilient force. The force is sufficient to keep the weight 51 from sagging a great deal when the racket is held vertically. It should be noted that the springs 49 and 50 may be formed as a single spring with the weight 51 clinched onto the center portion of the single spring.

In this form of the invention when the racket is swung, the weight may shift slightly to one side or the other of the plane 46, depending on acceleration forces. During any acceleration the weight and one of the springs 49 or 50 will store energy. When the ball (or other object) is struck with the spring portion of the racket (the racket is constructed as shown in FIG. 1) the stored energy will be exerted to tend to keep the racket moving in the direction of the swing to minimize rebounding of the racket as previously described. Thus, the weight 51 is suspended for movement in a direction transverse to the plane of the racket stringing, as represented by the line 46, and this movement of this weight (which is generally parallel to the direction of swing) is utilized to provide energy to minimize and reduce rebounding of the racket when the racket strikes a ball or object during a swing.

Again, some of the energy that is stored by either of the springs 49 or 50 and the weight 51 may be dissipated as heat, but a large portion of any stored energy will be useful for providing reactive force against the force tending to rebound the racket when it strikes a ball.

The weight 51 can be relatively light, again, in the range of a few ounces, so that it does not substantially affect the overall weight of the racket being used, nor will it adversely affect the balance of the racket. It does, however, provide a shifting mass that reacts to resist rebounding of the racket itself in a direction transverse to the plane of the racket as the racket strikes a ball.

The location of the transversely movable weights also may be changed from that shown. For example the weights could be mounted along both sides of the bow, or other desired locations. However the throat region is convenient and also close to the area where the ball is struck.

What is claimed is:

1. A sports racket having a bow portion, a handle attached to said bow portion and means providing a ball striking surface held by said bow portion, said ball striking surface generally defining a plane, a support attached to said racket adjacent the bow portion, and weight means movably retained relative to said support so as to permit substantially unrestrained movement of said weight means in direction transverse to said plane under forces generated during manual swinging of said racket to permit the weight means to physically shift when the sports racket strikes a ball, said weight means being of sufficient mass so that when the weight means shifts it effects a counteracting force reducing rebound of the sports racket after striking a ball.

2. The sports racket of claim 1 wherein said support comprises a container member and said weight means comprises shot captively retained in said container member.

3. The sports racket of claim 1 wherein said support is mounted adjacent the attachment area of said handle to said bow portion.

4. The sports racket of claim 3 wherein said support comprises a spring member resiliently mounting said weight means.

5. A sports racket having a bow portion defining a racket plane and having means for striking a sports missile and having a handle attached to said bow portion, said racket being capable of being manually swung in a striking direction to strike a sports missile, a hollow container mounted to the racket adjacent the bow portion and being attached to transmit forces on the container directly to the racket, a quantity of heavy discrete shot like particles partially filling said container and movable in said container without substantial restraint in opposite directions along an axis extending generally along the intended direction of swing of the racket generally perpendicular to the racket plane, said container having end walls generally normal to said axis against which the shot like particles impinge under forces along the axis, the force of said shot like particles hitting an end wall of said container when the racket strikes a sports missile during swinging thereof opposing the rebounding tendency of the racket.

6. The combination as specified in claim 5 wherein said handle is joined to said bow portion at a throat area, and wherein said container is mounted adjacent said throat area.

7. The combination of claim 5 wherein said handle comprises a pair of spaced members attached to said bow portion and defining an open throat, and wherein said container is mounted in the open throat area.

* * * * *